US005464526A

United States Patent [19]

Saunders

[11] Patent Number: 5,464,526

[45] Date of Patent: Nov. 7, 1995

[54] HYDROCRACKING PROCESS IN WHICH THE BUILDUP OF POLYNUCLEAR AROMATICS IS CONTROLLED

[75] Inventor: Dennis L. Saunders, Yorba Linda, Calif.

[73] Assignee: UOP, Des Plaines, Ill.

[21] Appl. No.: 250,023

[22] Filed: May 27, 1994

[51] Int. Cl.[6] ..... C10G 67/06; C10G 47/00; C10G 25/03

[52] U.S. Cl. ..... 208/108; 208/96; 208/98; 208/99; 208/58; 585/820; 585/858

[58] Field of Search ..... 208/98, 99, 108, 208/58, 87, 96, 310 R, 310 Z; 585/820, 858, 833

[56] References Cited

U.S. PATENT DOCUMENTS

| | | | |
|---|---|---|---|
| 1,886,260 | 11/1932 | Miller | 196/147 |
| 3,093,574 | 6/1963 | Bertolacini et al. | 208/91 |
| 3,575,844 | 4/1971 | Schutt | 208/90 |
| 3,619,407 | 11/1971 | Hendricks et al. | 208/48 R |
| 4,447,315 | 5/1984 | Lamb et al. | 208/99 |
| 4,734,226 | 3/1988 | Parker et al. | 260/420 |
| 4,781,864 | 11/1988 | Pryor et al. | 260/420 |
| 5,190,633 | 3/1993 | Fetzer et al. | 208/99 |

*Primary Examiner*—Asok Pal
*Assistant Examiner*—Bekir L. Yildirim
*Attorney, Agent, or Firm*—Yale S. Finkle

[57] ABSTRACT

The buildup of heavy polynuclear aromatic compounds in a hydrocracking system is controlled by contacting at least a portion of the recycle oil to the hydrocracker with a porous solid that has been treated with an acid. The porous solid serves as a support for the acid, thereby presenting the recycle oil with a high surface area for contact with the acid, which extracts the heavy polynuclear aromatic compounds from the recycle oil. A preferred acid-treated support is an amorphous silica that has been impregnated with sulfuric acid.

26 Claims, 3 Drawing Sheets

HYDROCRACKING PROCESS IN WHICH THE BUILDUP OF POLYNUCLEAR AROMATICS IS CONTROLLED

BACKGROUND OF THE INVENTION

This invention relates to a hydrocracking process in which the hydrocarbon feedstock has a tendency to form polynuclear aromatic compounds in the hydrocracking reactor and is particularly concerned with a method of removing the heavier polynuclear aromatic compounds from the hydrocracking system in order to prevent their buildup to a level which may cause deactivation of the hydrocracking catalyst and/or fouling of heat exchangers and other process equipment to such an extent that flow through and around such equipment is impeded.

Petroleum refiners often desire to produce products, such as gasoline and turbine fuel, by catalytically hydrocracking high boiling hydrocarbons into product hydrocarbons of lower average molecular weight and boiling point. Hydrocracking is generally accomplished by contacting, in an appropriate reactor vessel, a gas oil or other hydrocarbon feedstock with a suitable hydrocracking catalyst under appropriate conditions, including an elevated temperature and an elevated pressure and the presence of hydrogen, such that a hydrocarbon product is obtained containing a substantial portion of a desired product boiling in a specified range, as for example, a heavy gasoline boiling in the range of 185° to 420° F.

Oftentimes, hydrocracking is performed in conjunction with hydrotreating, usually by a method referred to as "integral operation." In this process, the hydrocarbon feedstock, usually a gas oil containing a substantial proportion of components boiling above a desired end point, as for example, 420° F. in the case of certain gasolines, is introduced into a catalytic hydrotreating zone wherein, in the presence of a suitable catalyst, such as a zeolite- or sieve-free, particulate catalyst comprising a Group VIII metal component and a Group VIB metal component on a porous, inorganic, refractory oxide support most often composed of alumina, and under suitable conditions, including an elevated temperature (e.g., 400° to 1000° F.) and an elevated pressure (e.g., 100 to 5000 p.s.i.g.) and with hydrogen as a reactant, the organonitrogen components and the organosulfur components contained in the feedstock are converted to ammonia and hydrogen sulfide, respectively. Subsequently, the entire effluent removed from the hydrotreating zone is treated in a hydrocracking zone maintained under suitable conditions of elevated temperature, pressure, and hydrogen partial pressure, and containing a suitable hydrocracking catalyst, such that a substantial conversion of high boiling feed components to product components boiling below the desired end point is obtained. Usually, the hydrotreating and hydrocracking zones in integral operation are maintained in separate reactor vessels, but, on occasion, it may be advantageous to employ a single, downflow reactor vessel containing an upper bed of hydrotreating catalyst particles and a lower bed of hydrocracking particles. Examples of integral operation may be found in U.S. Pat. Nos. 3,132,087, 3,159,564, 3,655,551, and 4,040,944, all of which are herein incorporated by reference in their entireties.

In some integral operation refining processes, and especially those designed to produce gasoline from the heavier gas oils, a relatively high proportion of the product hydrocarbons obtained from integral operation will have a boiling point above the desired end point. For example, in the production of a gasoline product boiling in the 185° F. to 420° F. range from a gas oil boiling entirely above about 530° F., it may often be the case that as much as 30 to 60 percent by volume of the products obtained from integral operation boils above 420° F. To convert these high boiling components to hydrocarbon components boiling below 420° F., the petroleum refiner separates the 420° F.+ high boiling components from the other products obtained in integral operation, usually after first removing ammonia by a Water washing operation, a hydrogen-containing recycle gas by high pressure separation, and an $H_2S$-containing, $C_1$ to $C_3$ low BTU gas by low pressure separation. This 420° F.+ boiling bottom fraction is then subjected to further hydrocracking, either by recycle to the hydrocracking reactor in single stage operation or by introduction into a second hydrocracking zone wherein yet more conversion to the desired 185° to 420° F. product takes place.

The feedstocks to hydrocracking systems, such as the one described above, will normally contain small amounts of compounds known as polycyclic aromatics or polynuclear aromatic compounds commonly referred to as "PNA's." The heavier polynuclear aromatic compounds, i.e., those containing seven or more fused benzene rings, typically have boiling points above about 950° F. and tend to be soluble in hydrocarbon oils only to the extent of several hundred ppmw. Quite frequently additional heavy polynuclear aromatic compounds will form in-situ as the feedstock to the hydrocracking system is first subjected to hydrotreating and then to hydrocracking at elevated temperatures and pressures. High endpoint feedstocks, such as vacuum gas oils, FCC cycle oils and coker gas oils, tend to be especially prone to the formation of heavy polynuclear aromatics during hydrotreating and hydrocracking. Thus, in a hydrocracking system as described above wherein the effluent from a hydrocracking reactor is separated into one or more lower boiling fractions and a higher boiling fraction containing unconverted oil, and this higher boiling fraction is recycled to the hydrocracking reactor, there is a tendency for these heavy polynuclear aromatic compounds to build up in the hydrocracking system and accumulate or "plate out" in cooler portions of the system, particularly heat exchange surfaces, transfer lines, valves and the like, thereby causing plugging problems and reduced heat exchange efficiency. Furthermore, these heavy polycyclic aromatic compounds are known to contribute to catalyst fouling and coking, and therefore their buildup in the hydrocracking system can have deleterious effects on catalyst activity. This is especially true as the hydrocracking temperature is increased. Examples of the types of heavy polynuclear aromatic compounds that can accumulate in a hydrocracking system and cause the above-mentioned problems are shown in U.S. Pat, Nos. 3,619,407 and 5,190,663, the disclosures of which are herein incorporated by reference in their entireties, and include coronene, peropyrene, naphthocoronene, benzocoronene, ovalene, their alkyl substituted derivatives, and the like.

In order to avoid the problems caused by the buildup of polynuclear aromatic compounds in hydrocracking systems wherein unconverted oil is recycled to the hydrocracking reactor, it has been suggested in U.S. Pat. No. 4,447,315, the disclosure of which is herein incorporated by reference in its entirety, that the unconverted oil first be treated with an adsorbent, such as a molecular sieve, silica gel, activated carbon, activated alumina, silica-alumina or clay, to remove these compounds from the oil. Although such adsorbents have a tendency to remove at least some of the heavy polynuclear aromatics from the hydrocracking system, they tend not to be as effective as most refiners would desire, and therefore there is a need for other methods of reducing the buildup of polynuclear aromatic compounds in hydrocracker process streams.

SUMMARY OF THE INVENTION

In accordance with the invention, it has now been found that the buildup of heavy polynuclear aromatic compounds in hydrocracking process streams and their subsequent fouling of process equipment and catalyst can be substantially avoided and/or significantly decreased by contacting a portion of the product or effluent oil stream from the hydrocracking reactor with a composition comprising an acid contained in the pores of a porous, solid support under conditions such that the heavy polynuclear aromatic compounds are selectively removed from the oil by the acid. Normally, it is preferred that the acid-impregnated support be used to remove the heavy polynuclear aromatic compounds from a portion of the heavy hydrocarbon oil exiting the bottom of the fractionator used to separate the effluent or product oil from the hydrocracking reactor into the desired product, e.g., gasoline or diesel fuel, and unconverted oil. The portion of the heavy unconverted oil contacted with the acidified support is then either recycled to the hydrocracking reactor, either directly or through the hydrotreater, (single-stage hydrocracking) or passed to a second hydrocracking reactor (two-stage hydrocracking) for conversion to lower boiling materials.

The composition used to remove the heavy polynuclear aromatics usually consists essentially of a rather strong acid, i.e., an acid typically having a $pK_a$ value of 2.0 or lower, supported on a porous, particulate material, such as an amorphous silica, an amorphous alumina, a porous carbon, a molecular sieve or a clay. A preferred composition comprises sulfuric acid supported on an amorphous silica such as a dried silica gel. Laboratory tests indicate that such an acid-treated amorphous silica is much more effective in removing heavy polynuclear aromatic compounds from hydrocracker recycle oils than is the amorphous silica itself. Thus, the process of the invention appears to be a significant improvement in the art of hydrocracking.

DETAILED DESCRIPTION OF THE INVENTION

Figure 1:
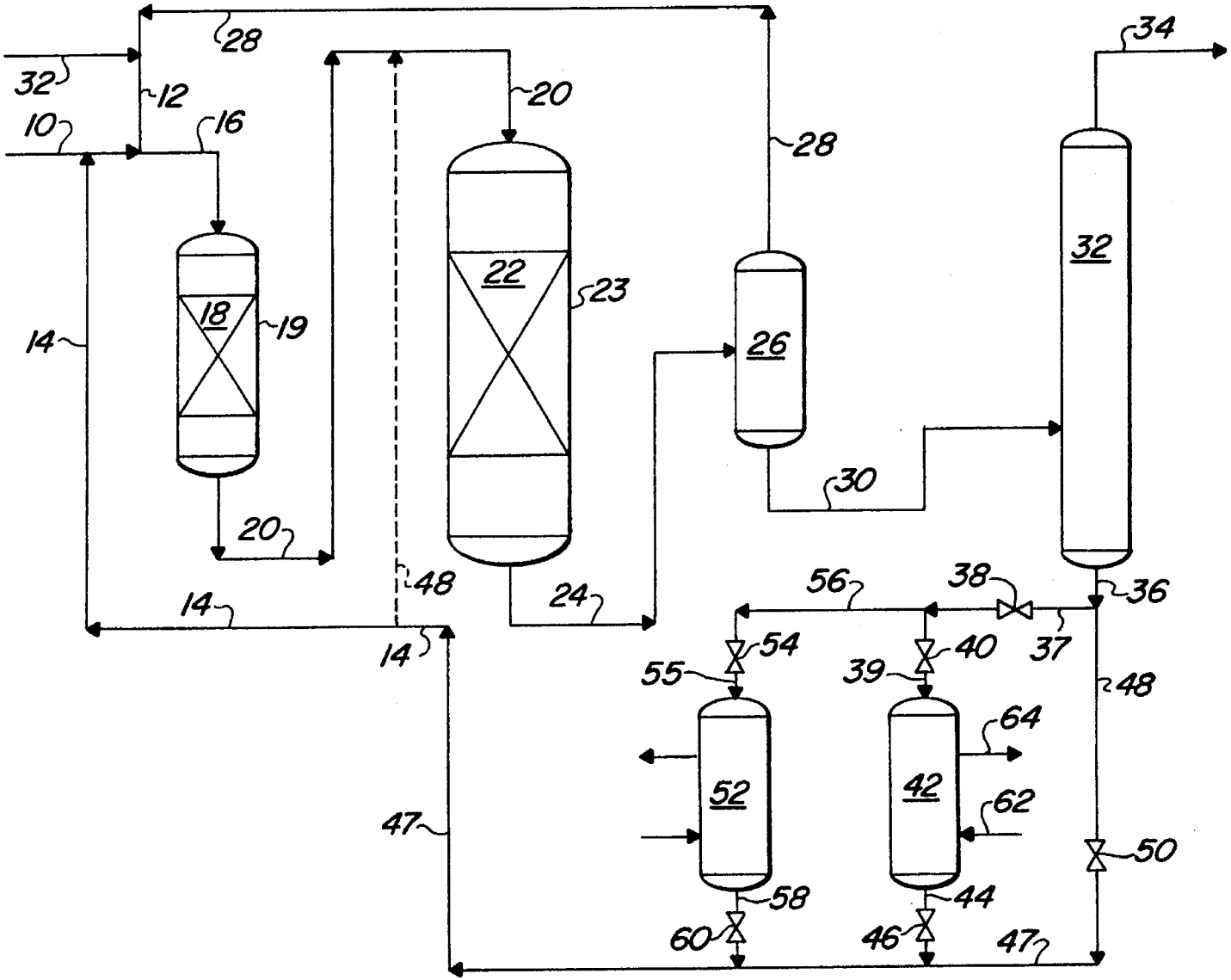
FIG. 1 in the drawing is a schematic flow diagram of a hydrocracking process in which the buildup of heavy polynuclear aromatic compounds in the hydrocracking system is controlled by the use of the process of the invention.

The process depicted in FIG. 1 is a preferred embodiment of the process of the invention in which a hydrocarbon feedstock is hydrocracked in a single stage to produce gasoline. It will be understood that the process of the invention is applicable to hydrocracking processes other than the one depicted in the drawing. For example, it can be used in single-stage hydrocracking processes to produce middle distillates, such as diesel and jet fuels, or in two-stage hydrocracking processes designed to produce either gasoline or middle distillates. It should be noted that FIG. 1 is a simplified process flow diagram and therefore does not show many types of equipment, such as heat exchangers, valves, separators, heaters, compressors, etc., not essential for understanding the invention by one skilled in the art of hydrocracking.

In the process shown in FIG. 1, a hydrocarbon feedstock is passed from a storage facility, not shown in the figure, into line 10 where it is mixed with a hydrogen-containing recycle gas introduced into line 10 through line 12 and a recycle oil stream introduced through line 14. The hydrocarbon feedstock may be a gas oil boiling above about 400° F., normally boiling in the range between about 550° F. and about 1200° F. The gas oil may be a straight run gas oil but is normally a vacuum gas oil, a cycle oil produced in a catalytic cracking process, a coker gas oil, or a mixture thereof. The latter two types of gas oils tend to contain heavy polynuclear aromatic compounds because they have relatively high end points and have been previously subjected to catalytic or thermal cracking at temperatures above about 650° F.

The mixture of hydrocarbon feedstock, recycle oil and recycle gas is passed through line 16 into hydrotreating zone 18 in hydrotreating reactor or hydrotreater 19 where it is contacted with a hydrotreating catalyst at a temperature normally in the range between about 400° F. and about 1000° F., preferably between about 650° F. and about 800° F. The hydrotreating pressure typically ranges between about 100 psig and about 5000 psig, preferably between about 500 psig and about 2000 psig. The liquid hourly space velocity is normally in the range between about 0.1 and about 15, preferably between about 2.0 and about 7.0.

The catalyst utilized in the hydrotreating zone is usually composed of a Group VIII metal hydrogenation component in combination with a Group VIB metal hydrogenation component supported on an amorphous, porous, inorganic, refractory oxide support such as alumina. In some cases phosphorus or other acid component may also be present in the combination. A preferred hydrotreating catalyst comprises a sulfided, particulate composition comprising a nickel or cobalt component, a molybdenum or tungsten component, and a phosphorus component on a support consisting essentially of alumina or alumina in combination with small amounts of silica. The catalyst is generally employed as a bed of particulates through which the feedstock and hydrogen-containing gas are passed downwardly under the conditions set forth above so as to convert the organonitrogen components in the feedstock to ammonia and the organosulfur components to hydrogen sulfide.

All of the products exiting hydrotreating reactor 19 are passed directly through line 20 into catalytic hydrocracking zone 22 in hydrocracking reactor or hydrocracker 23. The hydrocracking zone, as shown in the drawing, is in a separate vessel. Alternatively, the hydrocracking zone may be maintained in the lower portion of reactor 19 which contains the hydrotreating catalyst. In either case, the entire effluent from the hydrotreating zone is passed through the hydrocracking zone in contact with a hydrocracking catalyst under typical hydrocracking conditions so as to convert a specified percentage of the hydrotreated feedstock, such as 60 volume percent, to products boiling below a specified boiling end point, such as 420° F. for many gasolines. Normally, the temperature in the hydrocracking zone is maintained between about 450° F. and 800° F., preferably between about 600° F. and about 800° F., while the pressure varies from about 750 psig to 3500 psig, preferably from about 1000 psig to about 3000 psig. At such high temperatures and pressures, heavy polynuclear aromatic compounds may have a greater than normal tendency to form in the hydrocracking zone.

Although the catalyst used in the hydrocracking zone may be any conventional hydrocracking catalyst including amorphous catalysts such as the one disclosed and claimed in U.S. Pat. No. 4,062,809, herein incorporated by reference in its entirety, it is preferred that the catalyst contain a crystalline molecular sieve in combination with one or more hydrogenation components. The molecular sieve utilized in the hydrocracking catalyst may be either a zeolitic or nonzeolitic molecular sieve. Generally, a "nonzeolitic" molecular sieve is a sieve whose framework is not formed of substantially only silicon and aluminum atoms in tetrahedral coordination with oxygen atoms. A "zeolitic" molecular sieve is distinguished from a nonzeolitic molecular sieve in that its framework is formed of substantially only silicon and aluminum atoms in tetrahedral coordination with oxygen atoms, such as the framework present in ZSM-5 zeolites, Y zeolites and X zeolites.

The hydrocracking catalyst comprises one or more hydrogenation components containing metals selected from Group VIB and/or Group VIII of the Periodic Table of Elements. As used herein "Periodic Table of Elements" refers to the version found in the inside front cover of the *Handbook of Chemistry and Physics,* 65th Edition, published in 1984 by the Chemical Rubber Company, Cleveland, Ohio. Preferred hydrogenation components comprise metals selected from the group consisting of platinum, palladium, cobalt, nickel, tungsten, chromium, and molybdenum. Preferably, the catalyst contains at least one Group VIII metal component and at least one Group VIB metal component, with cobalt or nickel and molybdenum or tungsten being preferred combinations of active components.

The types of metals and molecular sieves utilized and their respective proportions in the catalyst will depend upon the desired end product from the hydrocracking process. Normally, when gasoline is the desired end product, the hydrocracking catalyst will comprise either a noble metal, such as platinum or palladium, or cobalt and molybdenum components on a support containing between about 50 and 90 weight percent of the molecular sieve. If, on the other hand, middle distillates, i.e., those hydrocarbons generally boiling in the range between about 300° F. and 700° F., are the desired end product, then the catalyst will typically comprise nickel and tungsten components on a support containing much less of the molecular sieve, normally between about 2 and 15 weight percent, in addition to an amorphous cracking component, such as silica-alumina or a dispersion of silica-alumina particles in a matrix of alumina.

An example of a typical gasoline hydrocracking catalyst is the noble metal-exchanged, stabilized Y zeolite-containing catalyst described as Catalyst A in Example 16 of U.S. Pat. No. 3,897,327, the disclosure of which is herein incorporated by reference in its entirety. Other gasoline hydrocracking catalysts are described in U.S. Pat. Nos. 4,584,287 and 5,228,979, the disclosures of which are herein incorporated by reference in their entireties. A typical catalyst used for producing maximum amounts of middle distillates comprises nickel components and tungsten components in combination with an ultrahydrophobic Y zeolite and a dispersion of silica-alumina particles in an alumina matrix. Such a catalyst is described in detail in U.S. Pat. No. 4,419,271, the disclosure of which is herein incorporated by reference in its entirety.

The effluent from hydrocracking reactor 23 is withdrawn through line 24 and passed through a heat exchanger, not shown in the figure, wherein it is cooled to condense normally liquid hydrocarbons. The cool mixture comprises gaseous hydrogen, light hydrocarbon gases, hydrocarbons boiling in the gasoline range, i.e., between about 185° F. and about 420° F., and higher boiling hydrocarbons including oil components that were not converted into lower molecular weight materials on passage through hydrocracker 23. This cooled effluent stream is passed into separator 26 wherein, at a temperature between about 50° F. and 800° F. and at a pressure from about 800 psig to 3000 psig, the hydrogen and light hydrocarbon gases are taken overhead through line 28 and the liquid hydrocarbons are removed through line 30. The hydrogen-containing gas removed overhead is recycled to hydrotreating reactor 19 through lines 28, 12 and 16. If additional hydrogen is required in the hydrotreater, make-up hydrogen may be added to the recycled gas through line 32.

The liquid hydrocarbons removed from separator 26 through line 30 are passed to fractionator 32 where the liquids are separated into a gasoline product boiling normally in the 185° F. to 420° F. range, other lower boiling hydrocarbons such as kerosine, if desired, and a heavy bottoms fraction containing unconverted oil and heavy polynuclear aromatic compounds. The gasoline product stream is removed overhead of the fractionator through line 34 while the heavy bottoms fraction, which normally contains less than 5, usually less than 1, ppmw each of copper, iron, nickel and arsenic, calculated as the element, is withdrawn from the bottom of the fractionator through line 36. Typically, this bottoms fraction is recycled to hydrocracking reactor 23, either directly or through hydrotreater 19, in order to obtain further conversion of the unconverted and other higher boiling hydrocarbons contained therein.

When the hydrocracking system depicted in FIG. 1 is operated with a continuous recycle of the fractionator bottoms, heavy polynuclear aromatic compounds in the feed and those produced at the conditions extant in hydrotreating zone 18 and hydrocracking zone 22 tend to build up in the system. These compounds are high boiling (usually above 950° F.) fused ring, polycyclic, aromatic hydrocarbons containing seven or more benzene rings and tend to have a low solubility in the other hydrocarbons found in the system. When the concentration of these polynuclear aromatic compounds rises to a level above their saturation solubility, usually somewhere between about 50 and 1000 ppmw, they have a tendency to accumulate in the cooler portions of the system, such as heat exchanger surfaces, valves and lines, where they can plug flow and reduce heat exchange efficiency. To control the buildup of these compounds, it has been the practice in the past to remove a bleed stream of the fractionator bottoms from the system prior to the recycling of the bottoms. Since this bleed stream can comprise from about 5 to 20 volume percent of the fractionator bottoms, it removes from the system, along with the heavy polynuclear aromatic compounds contained therein, a significant amount of higher boiling hydrocarbons which could be converted to added product upon recycle to the hydrocracker. This loss of product can be a major debit to the hydrocracking process. Although it may be possible in some cases to feed the bleed stream to a coker or to blend it into a fuel oil, these uses are of lower value than the gasoline or other product made in the hydrocracking process and result in an overall loss as compared to the situation where all of the fractionator bottoms are recycled to the hydrocracker.

To avoid the problems caused by removing a bleed stream of fractionator bottoms from the hydrocracking system, it is proposed in U.S. Pat. Nos. 5,190,633 and 4,447,315 that all or a portion of the bottoms from the fractionator be treated with an adsorbent, such as silica gel or activated carbon, in order to remove the polynuclear aromatic compounds. This method, while somewhat effective, is not very efficient and therefore requires large amounts of the adsorbent to remove enough polynuclear aromatic compounds to avoid operating problems in the hydrocracking system.

It has now been found that the level of heavy polynuclear aromatic compounds in a hydrocracking system can be easily controlled by contacting all or a portion of the heavy hydrocarbon fraction removed from the fractionator with an acid contained in the pores of a porous, solid support, such as a porous, particulate, inorganic, refractory oxide. It has also been found that these supported acids are far more effective and efficient in selectively removing heavy polynuclear aromatic compounds from the fractionator bottoms than adsorbents such as silica gel.

Referring again to FIG. 1, a hydrocarbon stream containing all or a portion of the bottoms from fractionator 32, which stream is usually substantially free of metals and arsenic, is fed through lines 36 and 37, control valves 38 and 40 and line 39 into extraction vessel 42 wherein it is passed downwardly through a packed bed of the acidified, porous support. During this contacting step, the acid in the pores of the particulate support selectively dissolves and/or reacts with the heavy polynuclear aromatic compounds in the portion of the fractionator bottoms fed to the extraction vessel. The resultant sludge, which comprises the acid, dissolved polynuclear aromatic compounds and reaction products produced when the acid reacts with the polynuclear aromatic compounds, is retained in the pores of the support. By placing the acid in the pores of the support, the heavy hydrocarbon fraction passing through the extraction vessel is exposed to a high surface area of the supported acid which results in an increased efficiency for removal of heavy polynuclear aromatics from the oil. Although the acidified support is referred to above as being present in vessel 42 as a packed bed, it will be understood that the support could be used in vessel 42 as a fluidized bed through which the fractionator bottoms is passed upward or it could be slurried with the bottoms in the vessel.

In general, the support used in the acidified composition in vessel 42 can be any porous, relatively high surface area, solid material that is inert to acid and therefore capable of maintaining good structural integrity during contact with the hydrocarbon oil passing through the extraction vessel. Typically, the support is a particulate, inorganic, refractory oxide having a pore volume between about 0.10 and 2.0, preferably between about 0.4 and 1.2, cubic centimeters per gram and a surface area of at least about 200, usually above about 300, and preferably between about 300 and about 800 square meters per gram. Examples of suitable support materials include amorphous silicas, amorphous aluminas, amorphous silica-aluminas, molecular sieves such as mordenite, porous carbons such as activated carbon, and clays including those that have been pillared and/or delaminated. Typically, a form of amorphous silica is preferred for use as the porous support. Examples of such silicas include fumed silicas, hydrated silicas, dried silica gels, and precipitated silicas.

The acid contained in the pores of the support may be any strong acid. Usually, the acid has a $pK_a$ value of 2.0 or below, is in its concentrated form, i.e., it will not be substantially diluted with water or other solvent, and is selective for extracting heavy polynuclear aromatic compounds from hydrocarbon oils. In general, the stronger mineral acids are most effective and are usually preferred. Examples of such acids include sulfuric acid, hydrochloric acid, phosphoric acid and nitric acid. Sulfuric acid and phosphoric acid are more preferred because hydrochloric acid may have a tendency to corrode the extraction vessel, and nitric acid may oxidize the oil passing through the vessel. When using sulfuric acid it is preferred that the acid contain less than 5, preferably no more than 2, weight percent water. Usually, organic acids are not suitable for use because they will dissolve in the oil being treated.

Normally, the amount of acid used to form the acidified support present in the extraction vessel is sufficient to fill from about 5 to about 80 percent of the pore space in the support. Sufficient empty pore space is generally needed to accommodate and retain the sludge formed when the acid dissolves and/or reacts with the heavy polynuclear aromatic compounds in the oil. Also, by limiting the amount of acid in the pores, unreacted acid is prevented from exiting the extraction vessel with the treated oil. Thus, in the process of the invention, it is normally not necessary to treat the oil exiting the extraction vessel 42 to neutralize acid or to remove acid sludge. In general, sufficient acid is used such that the resulting acidified support contains between about 3.0 and about 150 weight percent acid based on the weight of the support, preferably between about 5 and about 100 weight percent, and more preferably between about 15 and 65 weight percent.

The acid may be combined with the porous support by any method which effectively places the desired amount of acid into the pores of the support. For example, the acid may be impregnated into the support by spraying the support particles with the acid. Use of this method allows the concentration of acid in the support to be controlled by the amount sprayed onto the support. Another method of placing the acid into the support consists of slurrying the support material with a mixture of water and acid such that the pores fill with the water-diluted acid. Thereafter, the impregnated support is heated to evaporate the water, thereby leaving concentrated acid partially filling the pores of the support. This procedure ensures that space remains in the pores to retain the sludge formed upon reaction of the acid with the polynuclear aromatic compounds in the hydrocarbon oil treated in the extraction vessel.

Normally, the contacting of the fractionator bottoms oil with the acidified support in extraction vessel 42 is carried out at a temperature below the boiling point of the acid contained in the pores of the support. For example, if the acidified support comprises sulfuric acid, the temperature in the extraction vessel will normally be maintained below about 640° F., preferably between about 40° F. and about 300° F. Higher temperatures can be employed if the pressure in the extraction vessel is maintained above ambient levels. The residence time of the oil in the extraction vessel is sufficient to achieve the desired removal of heavy polynuclear aromatics from the oil. Although FIG. 1 shows the flow of hydrocarbons through vessel 42 to be in a downflow direction, it will be understood the upflow and radial flow configuration may be used if desired.

A hydrocarbon oil depleted in heavy polynuclear aromatic compounds and containing essentially no acid or sludge is withdrawn from extraction vessel 42 through line 44 and passed through valve 46 into line 47 from where it is recycled to hydrocracking reactor 23 either indirectly through hydrotreater 19 via lines 14, 10 and 16, or directly through lines 14, 48 and 20. The concentration of heavy polynuclear aromatics in the stream withdrawn from the extraction vessel through line 44 is significantly less than that in the oil fed to the extraction vessel through line 39. In general, the acidified support is initially effective in removing more than 50 weight percent of the heavy polynuclear aromatics from the feed to the extraction vessel.

In typical operations of the hydrocracking system shown in FIG. 1, it is desired that only a portion of the bottoms from fractionator 32 be passed through extraction vessel 42. Thus, it is preferred that at least 50 percent or more of the fractionator bottoms in line 36 be bypassed around extraction vessel 42 by means of line 48 and control valve 50. By treating only a portion of the fractionator bottoms in the extraction vessel, the amount of the acidified support necessary to remove heavy polynuclear aromatic compounds is kept at a minimum, while the equipment necessary to handle the portion of the fractionator bottoms treated is smaller and less expensive than if the entire bottoms stream was treated. In general, as little of the fractionator bottoms as is necessary to maintain the level of heavy polynuclear aromatics in the hydrocracker system within the range necessary to prevent fouling and plugging of equipment is passed through line 37, control valves 38 and 40 and line 39 into extraction vessel 42. Typically, the portion of the fractionator bottoms treated in the extraction vessel ranges between about 5 and 50 volume percent, preferably between about 5 and 15 volume percent.

At some point in time, the acidified support in extraction vessel 42 will become spent, i.e., it will no longer be effective for removing heavy polynuclear aromatic compounds from the oil fed into the extraction vessel through line 39. When this occurs, the oil fed to extraction vessel 42 can be diverted to a second extraction vessel 52 containing a fresh bed of the acidified support. This is done by closing valve 40 and passing the portion of the fractionator bottoms in line 37 through line 56, valve 54 and line 55 into extraction vessel 52. Here, this portion of the fractionator bottoms is passed downwardly through a fresh bed of acidified support so that heavy polynuclear aromatics can be removed without interruption during the hydrocracking operations. An oil depleted in polynuclear aromatic compounds and essentially free of acid and sludge is then removed from vessel 52 through line 58 and valve 60 and passed into line 47 for recycling back to the hydrocracking reactor either directly through lines 14, 48 and 20 or through hydrotreater 19 via lines 14, 10 and 16.

Once the flow of extraction bottoms is bypassed around extraction vessel 42, via lines 55 and 56 and valve 54, to extraction vessel 52, valve 46 in the outlet line from extraction vessel 42 can be closed to isolate the vessel from the hydrocracking system and allow regeneration of the spent, acidified support. This regeneration may be accomplished by feeding fresh, water-diluted acid into extraction vessel 42 through line 62 and passing it upward through the bed of spent, acidified support. As the diluted acid passes through the bed, it displaces sludge from the pores of the support. The resulting mixture of acid, sludge and water is withdrawn through line 64 and can be mixed with additional water to separate the acid from the heavy polynuclear aromatics and other hydrocarbons, which can then be disposed of by feeding them as slop to another process unit in the refinery. Acid is continuously passed through the bed in extraction vessel 42 until the majority of the sludge is removed from the pores of the acidified support. Regeneration of the support is then completed by passing an inert hot gas such as nitrogen through the bed to evaporate water from the pores of the support and thereby make room for sludge to accumulate during subsequent operations. The regenerated support is now ready for reuse when the acidified support in extraction vessel 52 becomes spent. When this occurs, the flow of fractionator bottoms to vessel 52 is terminated by closing valve 54, and the bottoms are diverted back through valve 40 and line 39 into extraction vessel 42.

In the embodiment of the invention shown in FIG. 1, the entire effluent from the hydrotreater is passed to the hydrocracker without further treatment, and all or a portion of the bottoms stream from fractionator 32 is contacted with the acidified, porous support in extraction vessel 42 to remove heavy polynuclear aromatic compounds before the bottoms stream is recycled to the hydrocracking reactor. It will be understood that the process of the invention is not limited to use in the hydrocracking process depicted in FIG. 1. For example, the invention could be used (1) in a system wherein the effluent from the hydrotreater is treated to remove hydrogen sulfide, ammonia, and light hydrocarbons prior to being passed to the hydrocracker or (2) in conjunction with a two-stage hydrocracking process in which the effluent from extraction vessel 42 or 52 and the fractionator bottoms bypassed around these vessels, instead of being recycled to the hydrocracker, are passed to a second hydrocracking reactor for further conversion of unconverted oil and other high molecular weight components into the desired product. It should also be noted that the buildup of heavy polynuclear aromatic compounds in the single-stage hydrocracking system depicted in FIG. 1 and in the two-stage hydrocracking system discussed above can be controlled by treating streams in the overall hydrocracking process scheme other than the fractionator bottoms with the acidified support. For example, all or a portion of the bottoms stream removed from separator 26 through line 30 could be treated with the acidified support before the bottoms stream is passed into fractionator 32.

The nature and objects of the invention are further illustrated by the following example, which is provided for illustrative purposes only and not to limit the invention as defined by the claims. The example illustrates that an acid-treated silica gel is much more effective than silica gel itself in removing various types of heavy polynuclear aromatic compounds from hydrocracker recycle oils.

EXAMPLE

Free flowing particles of an acidified silica gel were prepared by mixing 0.96 grams of concentrated sulfuric acid with 1.57 grams of Davidson Code 62 silica gel having a surface area of 340 $m^2$/gm, a pore volume of 1.15 cc/gm, and a particle size between 60 and 200 mesh on the Tyler Standard Screen Scale. The ability of these acid-treated particles and the untreated silica gel particles to remove heavy polynuclear aromatic compounds from a recycle hydrocracker oil was measured in a laboratory scale system in which the recycle oil was pumped by means of an Isco syringe pump through stainless steel tubing into the first of two columns in series. Both columns had a one-quarter inch outside diameter, a 4.6 millimeters inside diameter and were 101 millimeters in length. A trap comprising a one-eighth inch pipe "tee" fitting was placed between the two columns and connected with tubing to the outlet of the first column and the inlet of the second column.

In the first series of tests, 0.70 grams of the untreated silica gel particles were placed in the form of a fixed bed in each column. The beds were held in place by 400 mesh stainless steel screens placed at the top and bottom of each column. The recycle oil used was the bottoms from a fractionator whose feed was the liquid product from a hydrocracker containing a zeolite-based hydrocracking catalyst. The feed to the hydrocracker was a hydrotreated gas oil. The hydrocracker recycle oil had an API gravity of 34.4°, an initial boiling point of about 529° F., a final boiling point of about 997° F. and a 50 percent boiling point of about 742° F. with about 20 volume percent boiling below about 621° F., as determined by a modified ASTM D1160 distillation. In addition to heavy polynuclear aromatic compounds, the recycle oil contained about 1.4 ppmw nitrogen, about 47 ppmw sulfur, less than 0.2 ppmw copper, less than 0.1 ppmw nickel, less than 0.2 ppmw vanadium and less than 1.0 ppmw arsenic, all calculated as the element.

Five hundred milliliters of the recycle oil was passed at ambient temperature through the first column, the trap, and then through the second column. The effluent from the second column was collected in about 20 milliliter fractions in an Isco "Foxy" fraction collector. Selected fractions of collected oil were analyzed for two general categories of heavy polynuclear aromatic compounds using liquid chromatography procedures. The first analysis, which is herein referred to as "coronenes," was a measure of the amount of coronene and its alkyl derivatives in a collected fraction of treated recycle oil. The second analysis, herein referred to as "ovalenes," was a measure of the concentration of all polynuclear aromatic compounds having eight or more rings in a collected fraction of treated oil. The analysis denoted as "ovalenes" includes the amounts of peropyrene, benzocoronene and naphthocoronene in the collected fraction. The results of these measurements are set forth in FIGS. 2 and 3. As can be seen from these figures, the "coronenes" and "ovalenes" measurements for the recycle oil fed to the first column were 105 and 219 ppmw, respectively. After this series of tests was completed, the trap between the two columns was inspected and found to be free of sludge.

Figure 2:
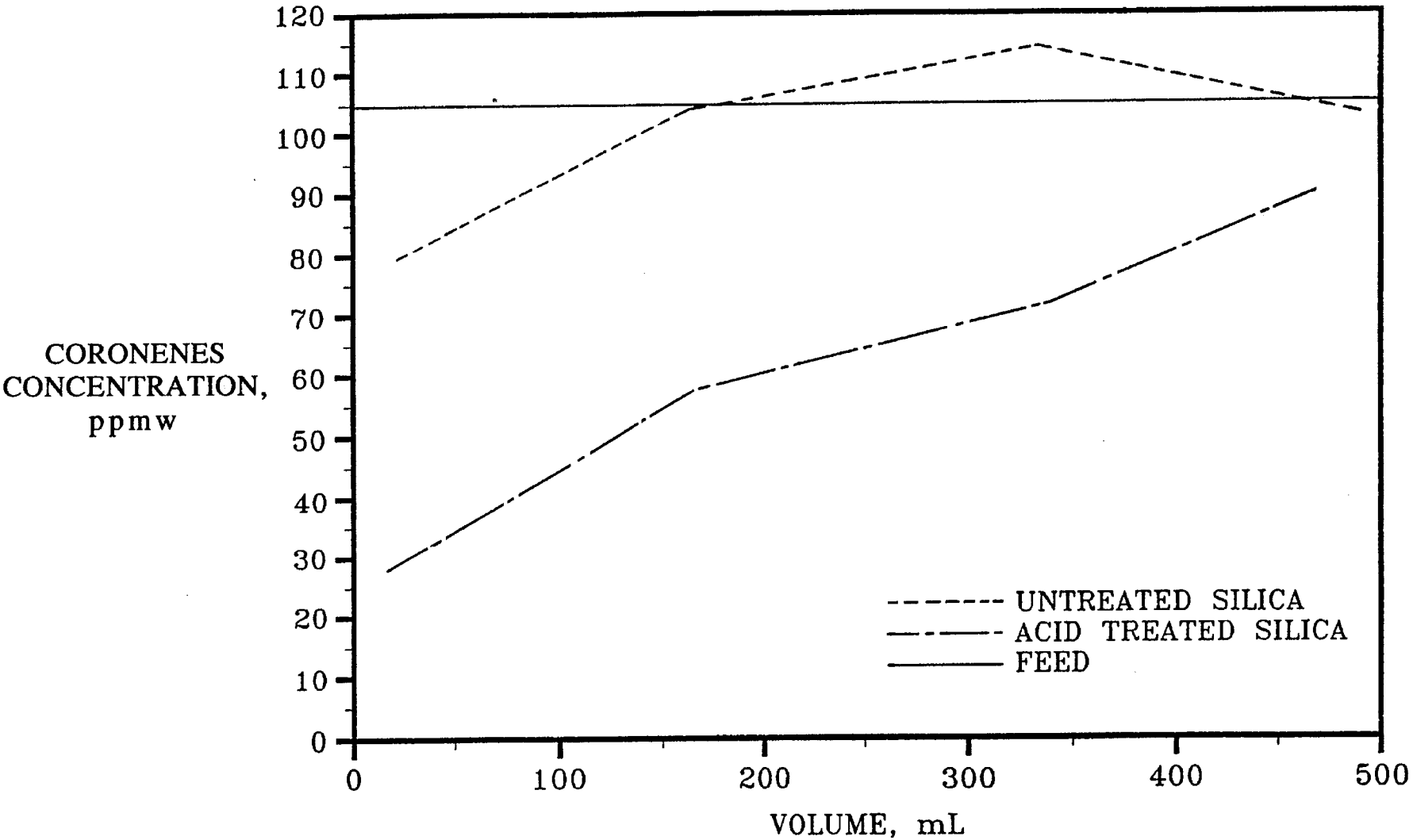
FIG. 2 is a plot which compares the concentrations of "coronenes" in a hydrocracker recycle oil after it has been contacted with a silica gel to the concentrations of "coronenes" in the oil after it has been contacted with a silica gel acidified with sulfuric acid.
Figure 3:
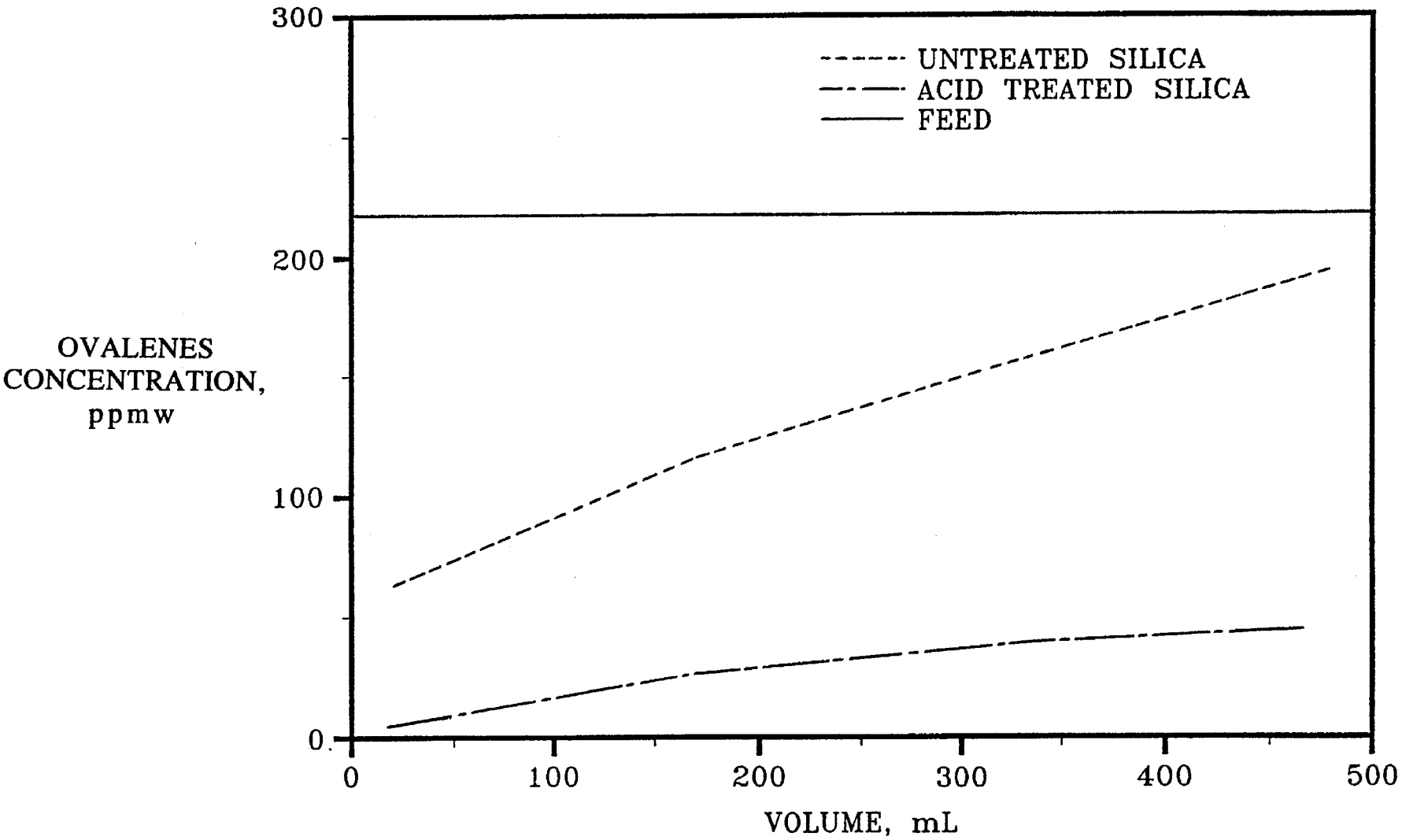
FIG. 3 is a plot which compares the concentrations of "ovalenes" in a hydrocracker recycle oil after it has been contacted with a silica gel to the concentrations of "ovalenes" in the oil after it has been contacted with a silica gel acidified with sulfuric acid.

In the second series of tests, the untreated silica gel in the first column was replaced with 0.70 grams of silica gel that had been acidified with 0.43 grams of concentrated sulfuric acid as described above, and fresh, untreated silica gel was placed in the second column. Again, 500 milliliters of the recycle oil was pumped at ambient temperature through the first column, the trap, and the second column. The effluent from the second column was collected in about 20 millimeter fractions which were analyzed for "coronenes" and "ovalenes" as described above. The results of the "coronenes" analyses are shown in FIG. 2 where they are compared to those obtained with the untreated silica gel. The results of the "ovalenes" analyses are shown in FIG. 3 and compared to those obtained when using the untreated silica gel. An inspection of the trap after completion of the tests indicated that no sludge had exited the first column.

As can be seen from FIG. 2, the acid-treated silica gel was much more effective in reducing the "coronenes" concentration than was the untreated silica gel. In the first approximately 15 milliliters collected from the second column in each series of tests, the concentration of "coronenes" was reduced from about 80 ppmw obtained with the untreated silica gel to about 27 ppmw when using the acidified silica gel-a decrease of over 65 percent. The data in FIG. 2 also show that the acid-treated silica gel was effective for a longer period of time as indicated by the fact that, after about 165 milliliters of recycle oil had passed through the two columns, the concentration of "coronenes" in the effluent from the system containing the untreated silica gel in the first column was equivalent to the 105 ppmw found in the feed, whereas the concentration after approximately 160 milliliters of effluent exited the system containing the acid-treated silica gel in the first column was only about 57 ppmw or about half as much.

FIG. 3 shows that the acid-treated silica gel is also more effective than the untreated silica gel in removing "ovalenes" from the recycle oil. The difference in effectiveness is especially significant after about 490 milliliters of recycle oil had passed through the two columns. At this point in time, the concentration of "ovalenes" in the effluent from the system containing the untreated silica gel in the first column was about 200 ppmw and had risen practically back to the concentration in the recycle oil feed. In contrast, the concentration in the effluent after about 470 milliliters had passed through the system containing the acid-treated silica gel in the first column was only about 45 ppmw.

The data plotted in FIGS. 2 and 3 clearly show that the acidified silica gel is far superior in removing heavy polynuclear aromatic compounds from hydrocracker recycle oil than is untreated silica gel. The extracting ability of the sulfuric acid significantly increases the amount of these compounds that can be removed by the silica gel alone. Moreover, the data show that the acid-treated silica gel is effective for a much longer period of time in removing "ovalenes" than is the untreated silica gel.

Although this invention has been described in conjunction with an example and by reference to several embodiments of the invention, it is evident that many alterations, modifications and variations will be apparent to those skilled in the art in light of the foregoing description. Accordingly, it is intended to embrace within the invention all such alternatives, modifications and variations that fall within the spirit and scope of the appended claims.

I claim:

1. A hydrocracking process which comprises:

(a) contacting a hydrocarbon feedstock in a hydrocracking zone with a hydrocracking catalyst in the presence of hydrogen under hydrocracking conditions to produce a hydrocracking product of lower average boiling point, said hydrocracking product containing polynuclear aromatic compounds;

(b) contacting at least a portion of said hydrocracking product with a composition comprising an acid contained in the pores of a porous, solid support under conditions such that at least a portion of said polynuclear aromatic compounds are removed from said product; and (c) withdrawing a hydrocarbon effluent from step (b) having a reduced concentration of polynuclear aromatic compounds.

2. A process as defined by claim 1 wherein said effluent contains essentially no acid.

3. A process as defined by claim 1 wherein said effluent contains essentially no sludge.

4. A process as defined by claim 1 wherein said contacting takes place at a temperature below the boiling point of said acid.

5. A process as defined by claim 1 wherein said acid has a $pK_a$ of about 2.0 or lower.

6. A process as defined by claim 5 wherein said porous support comprises an inorganic, refractory oxide.

7. A process as defined by claim 6 wherein said composition consists essentially of said acid and said porous, inorganic, refractory oxide support.

8. A process as defined by claim 1 wherein the portion of said product contacted with the acidified support in step (b) is essentially free of arsenic.

9. A process as defined by claim 1 wherein the portion of said product contacted with the acidified support in step (b) is essentially free of metals.

10. A hydrocracking process which comprises:

(a) contacting a hydrocarbon feedstock in a hydrocracking zone with a hydrocracking catalyst in the presence of hydrogen under hydrocracking conditions to produce a hydrocracking product of lower average boiling point;

(b) separating said hydrocracking product into at least one lower boiling hydrocarbon fraction and a higher boiling hydrocarbon fraction containing polynuclear aromatic compounds;

(c) passing at least a portion of said higher boiling hydrocarbon fraction into an extraction zone wherein it is contacted with a composition comprising an acid supported in the pores of a porous, particulate, inorganic, refractory oxide under conditions such that at least a portion of said polynuclear aromatic compounds are removed from said higher boiling hydrocarbon fraction to produce an effluent stream having a reduced concentration of polynuclear aromatic compounds as compared to the higher boiling hydrocarbon fraction passed into said extraction zone; and (d) withdrawing said effluent stream from said extraction zone.

11. A process as defined by claim 10 wherein said effluent stream contains essentially no acid.

12. A process as defined by claim 10 wherein said effluent stream is recycled to said hydrocracking zone.

13. A process as defined by claim 10 wherein said effluent stream is passed to a second hydrocracking zone wherein it is contacted with a second hydrocracking catalyst in the presence of hydrogen under hydrocracking conditions to convert said effluent stream into lower molecular weight hydrocarbon products.

14. A process as defined by claim 10 wherein said acid is selected from the group consisting of sulfuric acid, hydrochloric acid, phosphoric acid, and nitric acid.

15. A process as defined by claim 14 wherein said porous, inorganic refractory oxide is selected from the group consisting of amorphous silicas, amorphous silica-aluminas, amorphous aluminas, molecular sieves, and clays.

16. A process as defined by claim 10 wherein said composition comprises sulfuric acid supported in the pores of an amorphous silica.

17. A process as defined by claim 16 wherein said composition consists essentially of said sulfuric acid supported in the pores of said amorphous silica.

18. A process as defined by claim 10 wherein said composition comprises between about 15 and about 100 weight percent acid based on the weight of said inorganic, refractory oxide support.

19. A process for refining a hydrocarbon feedstock containing organonitrogen components, organosulfur components or a mixture thereof, which process comprises:

(a) contacting said feedstock in a hydrotreating zone with hydrogen under hydrotreating conditions in the presence of a hydrotreating catalyst such that a substantial proportion of the organonitrogen components, organosulfur components or mixture thereof is converted to ammonia, hydrogen sulfide or a mixture thereof;

(b) contacting substantially all the effluent from said hydrotreating zone with hydrogen in a hydrocracking zone in the presence of a hydrocracking catalyst to produce a hydrocracking product of substantially lower boiling point;

(c) separating said hydrocracking product into one or more lower boiling hydrocarbon fractions and a higher boiling hydrocarbon fraction containing polynuclear aromatic compounds;

(d) passing at least a portion of said higher boiling hydrocarbon fraction into an extraction zone wherein it is contacted with a composition comprising an acid supported in the pores of a porous, particulate, inorganic, refractory oxide under conditions such that at least a portion of said polynuclear aromatic compounds are removed from said hydrocarbon fraction to produce an effluent stream having a reduced concentration of polynuclear aromatic compounds as compared to the higher boiling hydrocarbon fraction passed into said extraction zone; and (e) withdrawing said effluent stream from said extraction zone.

20. A process as defined by claim 19 wherein said effluent stream is recycled to said hydrotreating zone.

21. A process as defined by claim 19 wherein said effluent stream is recycled to said hydrocracking zone.

22. A process as defined by claim 19 wherein said composition consists essentially of sulfuric acid or phosphoric acid supported in the pores of an amorphous silica or an amorphous alumina.

23. A process as defined by claim 19 wherein said composition comprises a fixed bed in said extraction zone.

24. A process as defined by claim 19 wherein said effluent stream from said extraction zone contains essentially no acid.

25. A process as defined by claim 19 wherein said higher boiling hydrocarbon fraction passed to said extraction zone is substantially free of glyceride oils.

26. A process as defined by claim 1 wherein said porous support comprises a porous carbon.

* * * * *